US006443137B1

(12) United States Patent
Kraft et al.

(10) Patent No.: US 6,443,137 B1
(45) Date of Patent: Sep. 3, 2002

(54) METHOD OF PRODUCING SPARK IGNITION ASSEMBLY WITH INTEGRAL SPARK PLUG AND IGNITION COIL

(75) Inventors: Judith P. Kraft, Pendleton; Patrick L. Gibson, Marion; James Alva Boyer, Anderson, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 9 days.

(21) Appl. No.: 09/658,440

(22) Filed: Sep. 8, 2000

(51) Int. Cl.[7] ..... F02P 11/00
(52) U.S. Cl. ..... 123/634; 123/635
(58) Field of Search ..... 123/608, 634, 123/635, 169 PA; 336/96; 439/88, 89

(56) References Cited

U.S. PATENT DOCUMENTS 5,706,792 A * 1/1998 Boyer et al. ..... 123/634
5,949,319 A * 9/1999 Nuebel et al. ..... 336/96
6,216,679 B1 * 4/2001 Skinner et al. ..... 123/635

* cited by examiner

*Primary Examiner*—Willis R. Wolfe
*Assistant Examiner*—Mahmoud Gimie
(74) *Attorney, Agent, or Firm*—Margaret A. Dobrowitsky

(57) ABSTRACT

A spark ignition assembly for use in a spark ignition system of an internal combustion engine, and an assembly method therefor. The spark ignition assembly includes a housing within which a spark plug, ignition coil and connector are housed. The spark plug has an insulator body, a first electrode and a ground electrode at a first end of the insulator body, and a terminal at an oppositely-disposed second end of the insulator body. The ignition coil is electrically connected to the terminal of the spark plug and to the connector, through which an electric voltage is applied to the ignition coil. The housing preferably contains a liquid injection molding (LIM) compound that surrounds the ignition coil and at least portions of the connector and spark plug.

12 Claims, 2 Drawing Sheets

METHOD OF PRODUCING SPARK IGNITION ASSEMBLY WITH INTEGRAL SPARK PLUG AND IGNITION COIL

TECHNICAL FIELD

The present invention generally relates to spark plugs for spark ignition in an internal combustion engine. In particular, this invention is directed to a spark ignition assembly having a spark plug and ignition coil contained within a single housing, and a process for the manufacture of such an assembly.

BACKGROUND OF THE INVENTION

With the exception of diesel engines, ignition systems for internal combustion engines typically involve igniting an air/fuel mixture within a combustion chamber with an electric spark jumped between electrodes of a spark plug. A single spark plug is typically threaded into a spark plug well for each cylinder of the engine. The high voltage required for spark ignition is typically stepped up from battery voltage with an ignition coil mounted separately within the engine compartment. Typically a single ignition coil services all of the spark plugs of an engine through a distributor.

In comparison to breaker-point systems, electronic ignition systems have significantly improved engine reliability, performance and efficiency while reducing maintenance through the use of a computer that coordinates fuel injection and ignition. In some more advanced electronic ignition systems, each spark plug is individually connected with a plug wire to an ignition coil paired exclusively with the plug, thus eliminating the need for a distributor. The computer individually triggers the coils to fire their respective plugs, using engine sensors to time the pulses correctly.

While ignition systems of the types described above are widely employed in the automobile industry, further improvements in automotive ignition systems are desirable, particularly if improved reliability can be achieved.

SUMMARY OF THE INVENTION

The present invention provides a spark ignition assembly for use in a spark ignition system of an internal combustion engine, and a method for manufacturing the spark ignition assembly. As with prior art spark plugs, the spark ignition assembly of this invention provides for the ignition of an air/fuel mixture within a combustion chamber by jumping a spark across a pair of electrodes. However, the spark ignition assembly of this invention improves system reliability by reducing the number of separate ignition system components that must be interconnected by external wiring.

The spark ignition assembly of this invention generally includes a housing within which a spark plug, ignition coil and connector are housed. The spark plug has an insulator body, a first electrode and a ground electrode at a first end of the insulator body, and a terminal at an oppositely-disposed second end of the insulator body. The ignition coil is electrically connected to the terminal of the spark plug and to the connector, through which an electric voltage is applied to the ignition coil. In a preferred embodiment, the housing contains a liquid injection molding (LIM) compound that surrounds the ignition coil and at least portions of the connector and spark plug. More particularly, the LIM compound preferably defines a boot that surrounds and grips the second end of the insulator body. Also in the preferred embodiment, the ignition coil employs an epoxy-impregnated secondary winding in order to ensure a void-free winding with adhesion to the secondary spool.

In the method of the present invention, the spark ignition assembly is manufactured by assembling the connector, the ignition coil and the spark plug in the housing so that the connector is electrically connected to the ignition coil for applying battery voltage to the coil, and the coil is electrically connected to the terminal of the spark plug for applying a stepped-up voltage to the plug. According to the preferred embodiment, the ignition coil and at least a portion of the connector is encased in the LIM compound prior to being assembled with the spark plug in the housing. Also in the preferred embodiment, the ignition coil and at least a portion of the connector is surrounded by a plastic case to form a subassembly, which then undergoes liquid injection molding prior to being assembled with the spark plug in the housing. During injection molding, a portion of the LIM compound is molded outside of the case to define the boot that grips the spark plug and therefore helps secure the plug to the housing.

In accordance with the above, the spark ignition assembly of this invention has the advantage of having a modular construction with fewer individual and separate components that must be interconnected with wires. In the preferred embodiment, the LIM compound encapsulates the ignition coil and a portion of the connector to form an environmentally protective encasement within the housing. The spark ignition assembly of this invention also has the advantage of being a reliable and robust product that can be assembled with relatively simple equipment and low capital investment. The spark plug assembly simplifies engine installation and provides a more cost-effective manufacturing process.

Other objects and advantages of this invention will be better appreciated from the following detailed description.

DESCRIPTION OF THE PREFERRED EMBODIMENT

Figure 1:
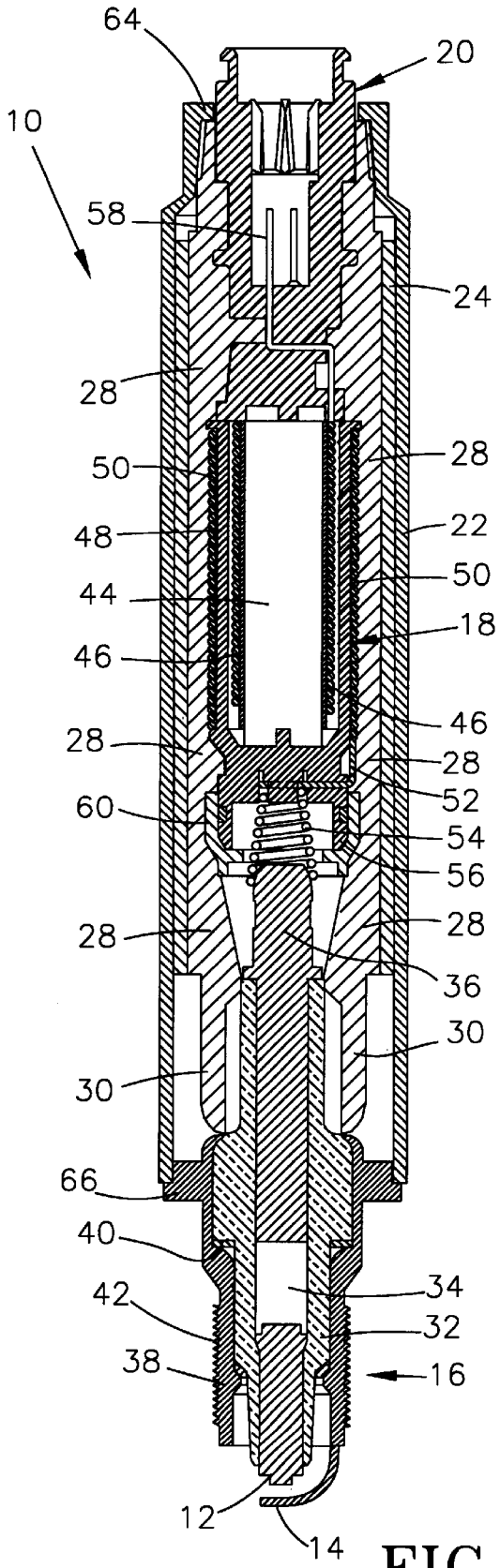
FIG. 1 shows a cross-sectional view along the longitudinal axis of a spark ignition assembly in accordance with this invention.
Figure 2:
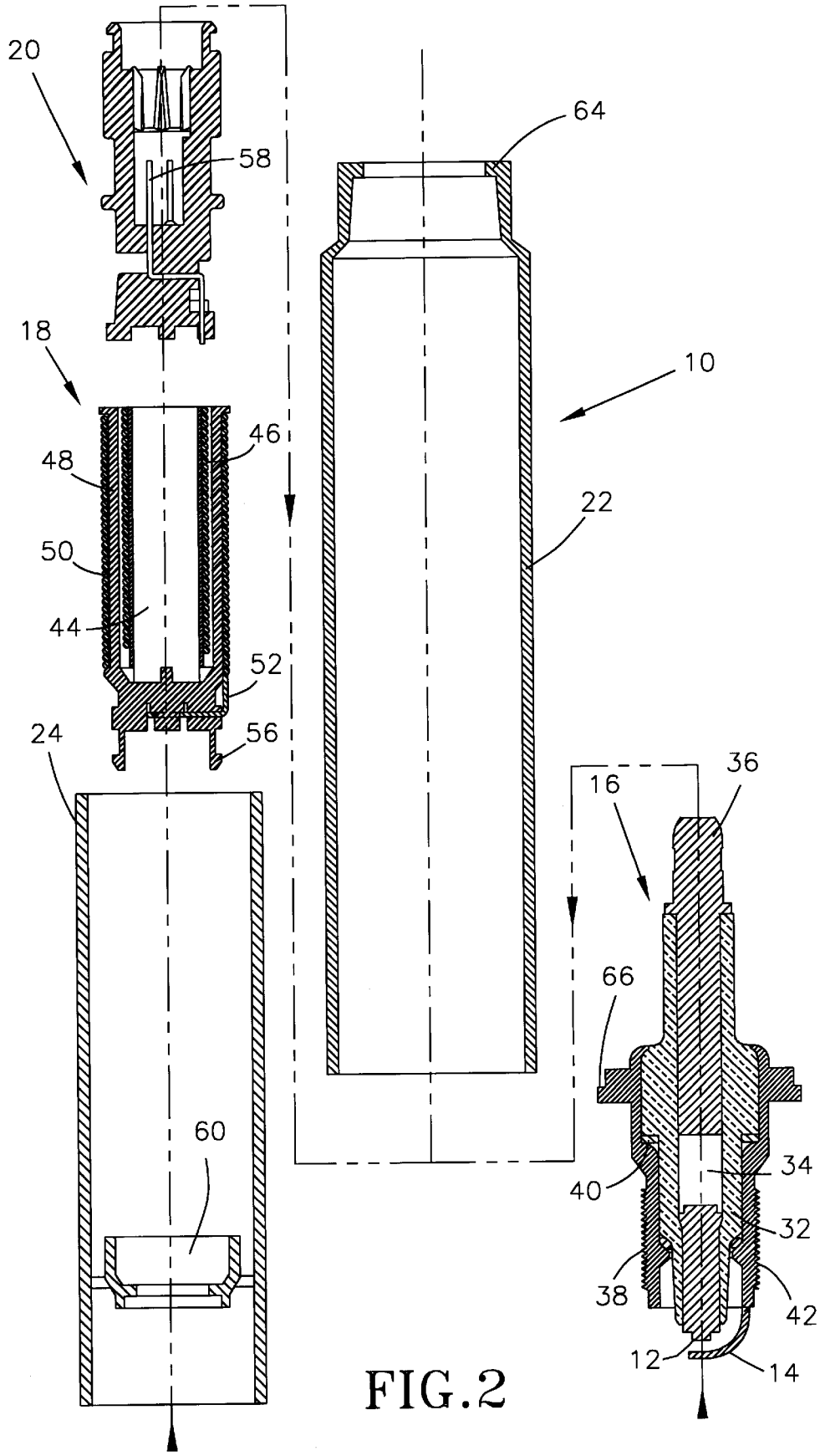
FIG. 2 is an exploded cross-sectional view of the spark ignition assembly of FIG. 1.

Shown in FIGS. 1 and 2 is a spark ignition assembly 10 for use in a spark ignition system of an internal combustion engine. In accordance with spark ignition systems of the past, the spark ignition assembly 10 of this invention is for the purpose of igniting an air/fuel mixture within a combustion chamber of an internal combustion engine by generating an electric spark across a gap between a center electrode 12 and a ground electrode 14. The center and ground electrodes 12 and 14 are components of a spark plug 16, which is one of three primary components of the spark ignition assembly 10. The two remaining components are an ignition coil 18 and a connector 20 through which a voltage is applied to the ignition coil 18. The plug 16, coil 18 and connector 20 are all housed within a metal housing shell 22 to provide a modular construction to the assembly 10. As most readily seen from FIG. 2, a fourth component of the assembly 10 is a case 24 that surrounds the ignition coil 18 and portions of the plug 16 and connector 20. As will be discussed below, the case 24 allows the coil 18 and connector 20 to be combined within a subassembly 26 (FIG. 3) that, following an injection molding operation, is installed with the plug 16 in the shell 22 to complete the assembly 10. The injection molding operation serves to fill the interior of the case 24 with a liquid injection molding (LIM) compound 28 to completely encase the ignition coil 18 and at least part of the connector 20. The LIM compound 28 also forms a boot 30 that surrounds and grips one end of the plug 16. While those skilled in the art will recognize that the spark plug 16 is similar to plugs used in existing automobile internal combustion engines, the teachings of the present invention are also applicable to other spark plug designs and configurations, as well as other applications which utilize internal combustion processes for power generation.

As with spark plugs typically used with internal combustion engines, the plug 16 includes an insulator body 32 that is preferably formed of a ceramic material, such as alumina ($Al_2O_3$). The insulator body 32 includes a passage 34 in which an upper terminal 36 is retained, by which an electric voltage is received from the ignition coil 18. An electric voltage introduced at the upper terminal 36 is conducted to the center electrode 12 located in the insulator body 32 opposite the upper terminal 36. The passage 34 is preferably filled with a resistor material, such as a glass seal resistor material of a type known in the art, which provides electromagnetic interference suppression. The ground terminal 14 is part of an electrically conductive shell 38 that houses the lower end of the insulator body 32. As is conventional, the center and ground electrodes 12 and 14 form a spark gap across which an ignition spark is generated. A gasket 40 formed of a suitable temperature-resistant material, such as copper or soft steel, is positioned between the insulator body 32 and shell 38 to create a gas-tight seal. External threads 42 are formed on the shell 38 for the purpose of installing the spark ignition assembly 10 in a threaded spark plug well (not shown).

The ignition coil 18 is shown as being composed of a primary core 44, a primary winding 46, a secondary spool 48 and a secondary winding 50. The primary winding 46 is wrapped around the core 44, which are then installed through an open end of the spool 48, which is wrapped by the secondary winding 50. The electric current produced by the ignition coil 18 is transmitted to the plug 16 through a terminal 52 insert-molded within the spool 48, and then through a conductive spring 54 retained within a cup 56 formed at a closed end of the spool 48. Those skilled in the art will be aware of the design and material requirements of the coil components for proper operation of the ignition coil. In one example, the ignition coil 18 of this invention was assembled with a core 44 formed of laminated steel, and wrapped with approximately ninety turns of #23 copper wire to form the primary winding 46. The spool 48 was formed of polyester and wrapped with approximately 6000 turns of #43 copper wire to form the secondary winding 50. The coil 18 was very compact, and produced a spark voltage from the secondary winding 50 of about 35,000 volts peak from a standard battery input of 12 VDC.

In a preferred embodiment of the invention, the secondary winding 50 is impregnated with an epoxy or other suitable protective polymeric material to provide a void-free encapsulation. Desired properties of the encapsulation material include structural and suitable dielectric properties. The secondary winding 50 can be impregnated with a vacuum pressure impregnation (VPI) process performed before final assembly of the coil 18.

The connector 20 generally has one end adapted to receive a male connector (not shown) of a type known in the art. A suitable material for the connector 20 is a polyester, though other materials could be used. A lead wire 58 insert-molded within the connector 20 and preferably welded or soldered to the primary winding 46 serves to conduct electric current to the primary winding 46.

Figure 3:
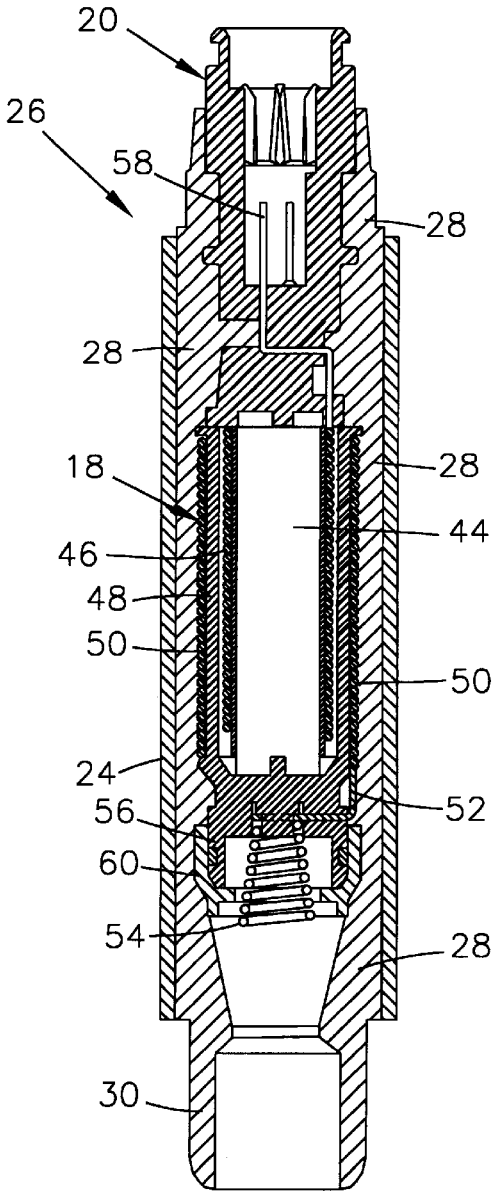
FIG. 3 is a cross-sectional view of an encapsulated subassembly of the spark ignition assembly of FIG. 1.

As illustrated in FIG. 3, the ignition coil 18 and connector 20 are assembled within the case 24, which is then filled with the LIM compound 28 through a liquid injection molding process. The case 24 includes a support ring 60 in which the cup 56 of the ignition coil 18 is received, as seen from FIGS. 1 and 3. The ring 60 also provides a surface against which the spring 54 abuts, which in turn electrically connects the ignition coil 18 (via the terminal 52) to the terminal 36 of the plug 16. From FIG. 3, the LIM compound 28 can be seen to fill the interior of the case 24 around the secondary winding 50 of the ignition coil 18. The LIM compound 28 can also be seen to surround much of the connector 20, including a portion of the connector 20 that protrudes outside the case 24. Similarly, the LIM compound 28 protrudes from the opposite end of the case 24, where it forms the integral boot 30 for the spark plug 16.

To form a structurally robust subassembly 26, the materials for the case 24 and LIM compound 28 must be compatible and capable of adhering to each other. In a preferred embodiment, the case 24 is formed of an adhesion-enhanced liquid crystal polymer (LCP) plastic available from DuPont. A preferred material for the LIM compound 28 is a liquid silicone rubber, such as a two-component product identified as 9070 and available from GE Plastics. These particular materials for the case 24 and LIM compound 28 have a temperature capability in excess of about 200 C. The 9070 liquid silicone rubber also has the advantage of being formulated to offer primerless adhesion, and therefore can adhere to a wide range of substrate materials without the use of a primer. The LIM process entails the use of mixing, dosing and injection molding equipment known in the art, by which injection volumes, mold pressure, temperature and cycle time can be precisely controlled. Because the LIM compound 28 protrudes from both ends of the case 24, a release coating may be used to ensure that the subassembly 26 releases freely from the mold.

Following the liquid injection molding operation, the subassembly 26 of FIG. 3 is assembled with the plug 16 into the shell 22 to complete the spark ignition assembly 10 of this invention. In this step, the subassembly 26 is inserted through the larger end of the shell 22 until the LIM compound 28 surrounding the connector 20 abuts an annular shoulder 64 formed at the smaller end of the shell 22. The spark plug 16 is then fitted into the larger end of the shell 22, so that a radial shoulder 66 formed on the shell 38 of the plug 16 engages the end of the housing shell 22, with the majority of the shell 38 protruding from the shell 22. When assembled, the terminal 36 of the plug 16 engages the spring 54, and the end of the insulator body 32 engages the boot 30 integrally formed on the subassembly 26 by a portion of the LIM compound 28. The plug 16 can then be secured within the shell 22 by welding or otherwise securing the shoulder 66 of the plug 16 to the shell 22.

While the invention has been described in terms of a preferred embodiment, it is apparent that other forms could be adopted by one skilled in the art. For example, appropriate materials could be substituted, and the order of assembly could be altered. Accordingly, the scope of the invention is to be limited only by the following claims.

What is claimed is:

1. A method of manufacturing a spark ignition device, the method comprising the steps of:

placing a connector and an ignition coil in a case to define a subassembly in which the connector and the ignition coil are axially aligned within the case, the connector is disposed at a first open end of the case, the ignition coil is between the connector and an oppositely-disposed second open end of the case, and the connector is electrically connected to the ignition coil for applying an electric voltage to the ignition coil;

injecting a liquid injection molding compound into the case to form an encapsulating compound that encases the ignition coil and at least a portion of the connector, the liquid injection molding compound being injected so that the encapsulating compound defines a boot that protrudes from the second open end of the case;

placing the subassembly within a housing so that the case and the boot protruding from the case are within the housing; and assembling a spark plug with the housing, the spark plug having electrodes at a first end thereof and a terminal at an oppositely-disposed second end thereof, the boot surrounding and contacting the second end of the spark plug, the ignition coil being electrically interconnected with the terminal of the spark plug.

2. A method according to claim 1, wherein the case has a tubular shape.

3. A method according to claim 1, wherein the case is formed of an adhesion-enhanced liquid crystal polymer plastic.

4. A method according to claim 3, wherein the liquid injection molding compound is a liquid silicon rubber, and the encapsulating compound formed by the liquid silicon rubber adheres to the case.

5. A method according to claim 1, wherein a portion of the encapsulating compound protrudes outside the first open end of the case.

6. A method according to claim 1, wherein the case comprises a support ring in which at least a portion of the ignition coil is received during the placing step.

7. A method according to claim 6, further comprising a spring supported with the support ring and electrically connecting the ignition coil with the terminal of the spark plug.

8. A method according to claim 1, wherein the ignition coil comprises a primary core, a primary winding around the primary core, and a polymer-impregnated secondary winding surrounding the primary winding.

9. A method according to claim 8, further comprising the step of impregnating the secondary winding with an epoxy to form an encapsulation that is encased by the encapsulating compound during the injecting step.

10. A method of manufacturing a spark ignition device, the method comprising the steps of:

forming a connector, an ignition coil and a spark plug, the ignition coil comprising a primary core, a primary winding around the primary core, and a secondary winding surrounding the primary winding and impregnated with a polymeric encapsulation material, the spark plug comprising an insulator body, a first electrode at a first end of the insulator body, a terminal at an oppositely-disposed second end of the insulator body, a conductive shell surrounding the first end of the insulator body, and a ground electrode electrically connected to the conductive shell;

assembling the connector and the ignition coil with a plastic case so that the connector protrudes from a second end of the plastic case, the primary winding of the ignition coil being electrically connected to the connector so that an electric voltage applied to the connector is conducted to the ignition coil;

injecting a liquid injection molding compound into the plastic case so that a first portion of the liquid injection molding compound is between and contacts the plastic case and the polymeric encapsulation material of the secondary winding of the ignition coil, a second portion of the liquid injection molding compound is between and contacts the plastic case and the connector, and a third portion of the liquid injection molding compound protrudes from the plastic case to define a boot, the plastic case, the connector, the ignition coil, and the liquid injection molding compound defining a subassembly; and then installing the subassembly and the spark plug in a housing, the conductive shell of the spark plug protruding from a first end of the housing and the connector protruding from a second end of the housing, the secondary winding of the ignition coil being electrically connected to the terminal of the spark plug so that a higher electric voltage produced by the ignition coil is conducted to the spark plug.

11. A method according to claim 10, wherein the liquid injection molding compound is a silicone rubber.

12. A method according to claim 10, wherein the plastic case is formed of an adhesion-enhanced liquid crystal polymer plastic.

* * * * *